US008006500B1

(12) United States Patent
Wilson, III

(10) Patent No.: US 8,006,500 B1
(45) Date of Patent: Aug. 30, 2011

(54) SWIRL COMBUSTOR WITH COUNTER SWIRL FUEL SLINGER

(75) Inventor: Jack W. Wilson, III, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 836 days.

(21) Appl. No.: 12/021,456

(22) Filed: Jan. 29, 2008

(51) Int. Cl.

| | |
|---|---|
| ***F23R 3/20*** | (2006.01) |
| ***F23D 11/04*** | (2006.01) |
| ***B05B 3/00*** | (2006.01) |
| *F23R 3/50* | (2006.01) |

(52) U.S. Cl. ..... 60/776; 60/745; 431/168; 239/214.15

(58) Field of Classification Search ..... 60/776, 60/744, 745; 431/168; 239/214.25, 222.11
See application file for complete search history.

(56) References Cited

U.S. PATENT DOCUMENTS

| | | | | |
|---|---|---|---|---|
| 2,568,921 | A * | 9/1951 | Kroon | 60/745 |
| 2,617,252 | A * | 11/1952 | Klein | 60/744 |
| 2,784,551 | A * | 3/1957 | Karlby et al. | 60/745 |
| 2,787,319 | A * | 4/1957 | Ryder | 431/168 |
| 2,981,066 | A * | 4/1961 | Johnson | 60/745 |
| 3,408,154 | A * | 10/1968 | Bachi, Jr. | 239/214.15 |
| 3,932,988 | A * | 1/1976 | Beaufrere | 60/745 |
| 4,045,159 | A * | 8/1977 | Nishi et al. | 60/744 |
| 6,003,297 | A * | 12/1999 | Ziegner | 60/776 |
| 6,925,812 | B2 * | 8/2005 | Condevaux et al. | 60/776 |

* cited by examiner

*Primary Examiner* — Ted Kim
(74) *Attorney, Agent, or Firm* — John Ryznic

(57) ABSTRACT

A combustor for a small gas turbine engine in which a compressor discharges a swirling air flow into the combustor, and a fuel impeller is rotatably connected to the compressor and slings atomized fuel into the combustor in a direction to produce a stagnation zone within the combustor. A plurality of fuel injectors delivers fuel to the inlet end of the fuel impeller. The combustor outlet is a nozzle shape that produces a high enough pressure level in the swirl air flow such that the cooler air flows along the inner combustor wall to form an insulation layer from the hot combustor gas flow within the combustor. The fuel impeller produces a very fine mist of fuel and the stagnation zone produced results in easy starting of the engine and stable combustor burning.

7 Claims, 2 Drawing Sheets

SWIRL COMBUSTOR WITH COUNTER SWIRL FUEL SLINGER

BACKGROUND OF THE INVENTION

1. Field of the Invention

The present invention relates generally to a small gas turbine engine, and more specifically to a swirl combustor.

2. Description of the Related Art Including Information Disclosed Under 37 CFR 1.97 and 1.98

In a gas turbine engine, a compressor supplies compressed air into a combustor, a fuel is burned in the combustor to produce a hot gas flow, and the hot gas flow is passed through a turbine to drive the compressor. In a small engine, swirl combustors are used to burn the fuel in a small combustor space. A typical straight-though combustor, like those found on larger engines, burn the fuel along a straight path through the combustor. In a small engine, the combustor space is limited. Thus, swirl combustors increase the distance in which the fuel particles can travel within the combustor without increasing the axial length of the combustor.

One major problem with small swirl combustors is igniting the fuel. A swirl combustor will also produce a very fine mist of fuel particles that can burn completely in a shorter travel distance within the combustion zone. The fine atomization of the fuel in a rotary cup fuel injector will produce a fine fuel mist 10 times that of a fuel injector nozzle. The U.S. Pat. No. 6,983,606 B2 issued to Brown on Jan. 10, 2006 discloses a rotary cup combustor for a small gas turbine engine, and is herein incorporated by reference.

In a swirl combustor, another major problem is in the initial ignition of the fuel to start the engine. A swirl combustor produces a high velocity air flow into the combustor that can blow out any flame used to ignite the fuel and air mixture. In the past, pyrotechnic igniters have been used that produce an explosion to ignite the fuel and air mixture. However, pyrotechnic igniters are expensive and add considerable weight. Glow-plugs are used to start hobby-type gas turbine engines because they are cheap. However, glow plugs stay on continuously and therefore do not last long. Fuel nozzles are also expensive and can easily clog. Together, fuel nozzles and pyrotechnic igniters can account for 40% or more of the overall cost of a small gas turbine engine.

BRIEF SUMMARY OF THE INVENTION

It is therefore an object of the present invention to provide for a small combustor that can be easy to start.

It is another object of the present invention to provide for a small combustor that can produce a very fine mist of fuel.

It is another object of the present invention to provide for a small combustor with a very low relative combustor wall temperature.

It is another object of the present invention to provide for a small gas turbine engine that is low in cost to manufacture.

The present invention is a swirl combustor with a centrifugal impeller to provide a compressed air to the combustor in which the compressed air is discharged into the combustor with a high rate of swirl, and a second impeller connected to the first impeller by a common rotor shaft and located downstream in the swirl direction from the first impeller. The second impeller is used to sling a fuel into the combustor chamber but is an opposite swirl direction from the compressed air in order to produce a stagnation zone within the combustor chamber such that the combustor can be easily started. Fuel is injected onto the inlet end of the second impeller and formed into a very fine mist from the rotation of the impeller.

The combustor includes a converging exit end or nozzle in which the hot gas flow passes. The combustor nozzle produces a pressure increase on the swirl flow of compressed air so that the colder air travels along the inner wall of the combustor. This colder film of air along the inner combustor wall produces a combustor wall temperature below 400 degrees F.

DETAILED DESCRIPTION OF THE INVENTION

Figure 1:
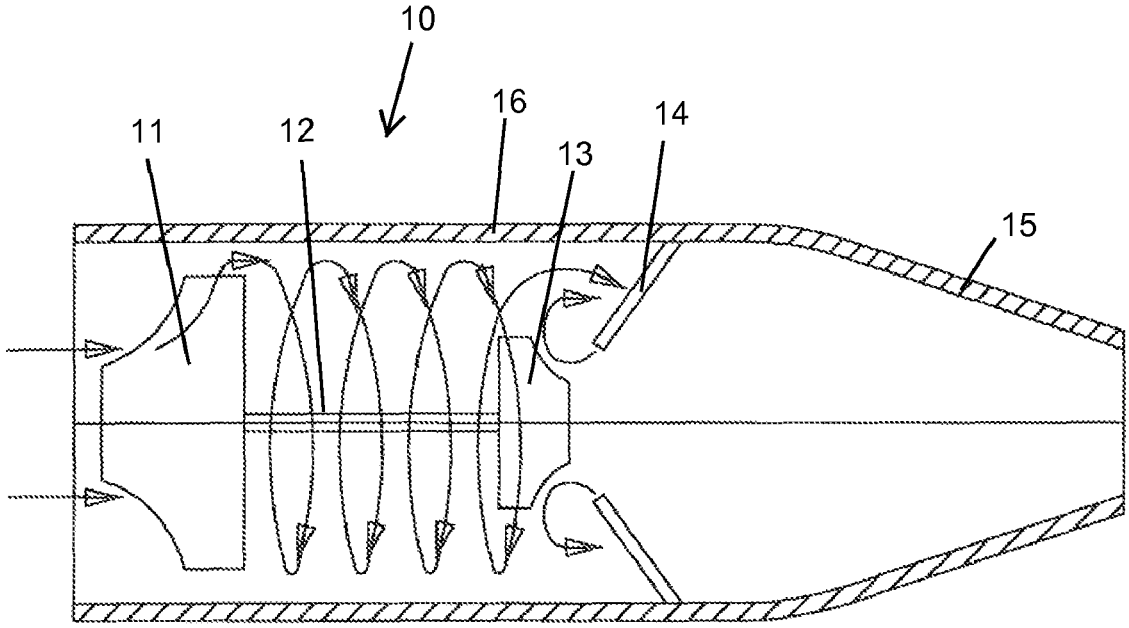
FIG. 1 shows a cross section side view of the small combustor of the present invention.

A small gas turbine engine for use in a UAV (unmanned aero vehicle) or other small aircraft includes a swirl combustor with a converging exit end or nozzle. FIG. 1 show the combustor 10 used in a small gas turbine engine. The combustor includes a centrifugal compressor 11 to produce a compressed air for use in the combustor. The centrifugal compressor includes blades that form a "right hand" impeller and discharge the compressed air in a direction that results in a swirl flow pattern within the combustor. The arrows represent the direction of the swirl flow of the compressed air.

Connected to the centrifugal impeller 11 by a rotor shaft 12 is a second and smaller impeller 13 with blades that form a "left hand" impeller and opposite to that of the centrifugal impeller 11. The small impeller 13 is of such size to allow for the swirling compressed air to flow around without blocking the flow of compressed air. Two or more fuel injectors 14 are located to inject the fuel onto the inlet surface of the second or fuel impeller 13. The fuel injectors 14 can be tubes that inject raw fuel as a liquid or can be injector nozzles that inject a fine mist of fuel. Because of the small size of the gas turbine engine, the rotational speed of the two impeller is very high, in the order to 25,000 to 100,000 rpms. With this high rotational speed, a liquid fuel (such as JP10) is forced outward and injected into the swirling compressed air as a very fine mist. Because the fuel impeller 13 has blades forming a left had or opposite direction than the centrifugal impeller 11, a stagnation zone is formed where the fuel mist and the compressed swirling air meet. This allows for a very easy start of the engine since a high rate of flow of the compressed air is not formed that can act to blow out any starting flame. The stagnation zone also provides for a stable flame to avoid unexpected flameout during engine operation. In the first embodiment, the centrifugal impeller 11 is about 3.5 inches in diameter and the fuel impeller 13 is about 3 inches. Other sizes will also work. Also, the turbine of the engine is connected to the rotor shaft on which the centrifugal impeller 11 and the fuel impeller 13 rotate with. The turbine is not shown in the figure.

Another important feature of the combustor of the present invention is the exit end of the combustor has a converging form such as a nozzle 15. The nozzle 15 produces a restriction in the compressed air flow that forms a layer of colder air along the inner surface of the combustor wall 16. The hotter combustion gas is thus separated from the combustor wall by this relatively colder layer of air. Therefore, the combustor wall operate at a much lower temperature than the prior art combustors. In a combustor of about 5 inches in diameter, the applicant has found that the combustor walls operate at around 400 degrees F. therefore, the combustor does not require cooling and can therefore operate longer. Also, no insulation would be required in an engine used in an small aero craft such as a UAV.

A capacitive discharge device is used to start the combustor of the present invention. A high voltage electric spark is produced that will ignite the fuel and air mixture in the stagnation zone. Also, use of a fuel having a long shelf life such as JP10 fuel can be used in a small gas turbine engine with the combustor of the present invention, since a fuel like JP 10 is very difficult to ignite in prior art combustors. The fuel impeller and the stagnation zone provide for a location in which this type of fuel can easily be ignited.

In the above description, the centrifugal impeller was described as being a "right hand" impeller while the fuel impeller was a "left hand" impeller. However, a "left hand" centrifugal impeller with a "right hand" fuel impeller would also produce the same results. What is desired is that the swirl flow of the compressed air is opposite to the flow of the fuel mist in order to generate the stagnation zone.

Figure 2:
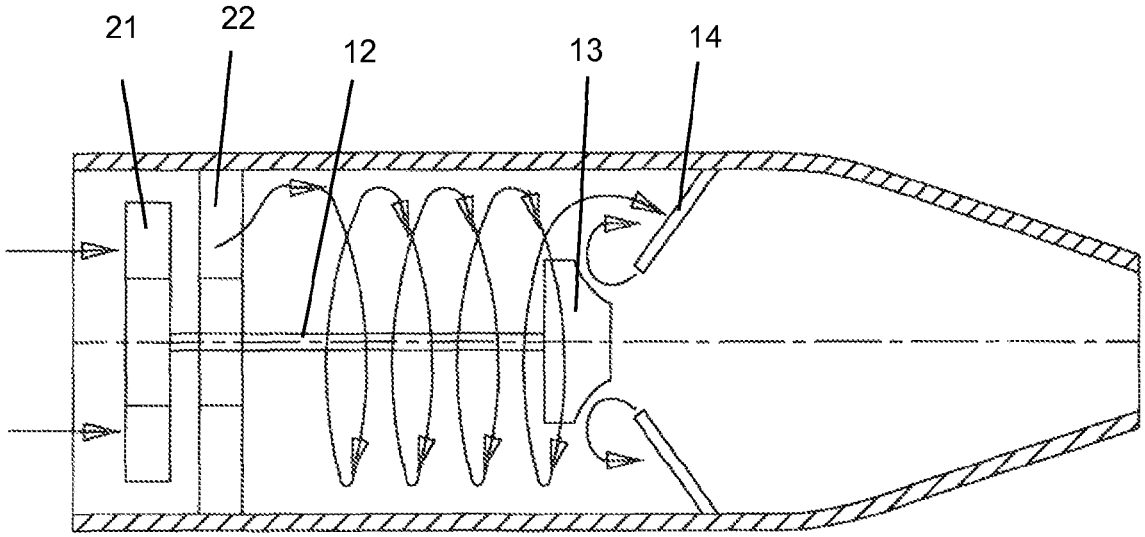
FIG. 2 shows a cross section side view of a second embodiment of the present invention.

In still another embodiment, an axial flow compressor could be used with the addition of vanes that will produce a swirling motion of the compressed air into the combustor. The swirl vanes would discharge the compressed air in either a clockwise or counter-clockwise swirl direction while the fuel impeller would discharge the fuel in the opposite swirl direction in order to establish the stagnation zone. FIG. 2 shows this embodiment with an axial flow compressor 21 with a swirl vane located downstream to produce the swirling motion in the combustor.

The swirl combustor with the counter swirl fuel slinger could be used in an apparatus other than a gas turbine engine. A kerosene space heater could use the swirl combustor in order to produce a lower wall surface temperature of the heater. Such prior art kerosene heaters can be a hazard in that the outer wall temperature is so hot that items could be set ablaze. The swirl combustor of the present invention would significantly reduce this hazard due to the cooler swirling air forming an insulation layer for the hot combustion air.

I claim:

1. A swirl combustor comprising:

a combustion chamber;

a compressor impeller to supply compressed air in a swirl motion to the combustion chamber;

a fuel impeller rotatably connected to the centrifugal impeller; the fuel impeller has an axial inlet and a radial outlet discharging fuel in a radial direction and to oppose the swirl motion of the compressed air;

the fuel impeller is located within the combustion chamber of the combustor;

the fuel impeller having an inlet end facing an aft end of the combustor which exhausts combustion gas; and, a fuel injector directed to discharge fuel at the inlet end of the fuel impeller.

2. The swirl combustor of claim 1, and further comprising:

an exit end of the combustor chamber is formed as a nozzle to produce a high swirl flow rate.

3. The swirl combustor of claim 1, and further comprising:

the fuel injector is a fuel injector tube to inject liquid fuel.

4. The swirl combustor of claim 1, and further comprising:

the compressor impeller is an axial flow compressor; and, a plurality of swirl vanes located downstream from the compressor outlet to produce the swirl motion of the compressed air.

5. The swirl combustor of claim 1, and further comprising:

the compressor impeller is an axial inlet and a radial outlet impeller;

the compressor impeller has blades with one of a right hand or left hand arrangement; and, the fuel impeller has blades with the other of the right hand or left hand arrangement.

6. A process for combusting a fuel in a small gas turbine engine comprising the steps of:

passing a compressed air into a combustion chamber with a swirling flow direction;

slinging a fuel from a fuel impeller with an axial inlet facing an aft end of the combustion chamber which exhausts combustion gas, and a radial outlet discharging fuel in a radial direction within the combustion chamber in a swirling direction opposite to the swirling direction of the compressed air to produce a stagnation zone within the combustor;

combusting the compressed air and fuel mixture within the stagnation zone; and, restricting the combustion gas flow out from the combustor to produce a high swirl flow rate such that cooler air flows along the combustor inner wall surface.

7. The process for combusting a fuel of claim 6, and further comprising the steps of:

compressing air with an axial flow compressor; and, swirling the compressed air using swirl vanes located between the axial flow compressor and the combustion chamber.

* * * * *